US006732815B2

(12) United States Patent
Hanke et al.

(10) Patent No.: US 6,732,815 B2
(45) Date of Patent: May 11, 2004

(54) HAMMER

(75) Inventors: Andreas Hanke, Bad Camberg (DE); Achim Buchholz, Limburg (DE); Ralf Bernhart, Idstein (DE)

(73) Assignee: Black & Decker, Inc., Newark, DE (US)

( * ) Notice: Subject to any disclaimer, the term of this patent is extended or adjusted under 35 U.S.C. 154(b) by 0 days.

(21) Appl. No.: 10/092,754

(22) Filed: Mar. 7, 2002

(65) Prior Publication Data

US 2002/0125023 A1 Sep. 12, 2002

(30) Foreign Application Priority Data

Mar. 7, 2001 (GB) ..... 0105547
Oct. 26, 2001 (GB) ..... 0125749

(51) Int. Cl.[7] ..... B25D 17/00

(52) U.S. Cl. ..... 173/201; 173/200; 173/210; 173/212

(58) Field of Search ..... 173/109, 122, 173/132, 200, 201, 210, 212

(56) References Cited

U.S. PATENT DOCUMENTS

| | | | | |
|---|---|---|---|---|
| 1,591,930 A | | 7/1926 | Smith | |
| 3,028,840 A | | 4/1962 | Leavell | |
| 3,179,185 A | | 4/1965 | O'Farrell | |
| 3,255,832 A | | 6/1966 | Leavell | |
| 3,507,337 A | * | 4/1970 | Chromy | 173/14 |
| 3,650,336 A | * | 3/1972 | Koehler | 173/110 |
| 3,921,729 A | * | 11/1975 | Schmuck | 173/14 |
| 4,068,727 A | | 1/1978 | Andersson et al. | |
| 4,133,394 A | | 1/1979 | Wohlwend | |
| 4,276,941 A | * | 7/1981 | Wanner et al. | 173/117 |
| 4,336,848 A | | 6/1982 | Wanner | |
| 4,476,941 A | | 10/1984 | Buck et al. | |
| 4,585,077 A | * | 4/1986 | Bergler | 173/48 |
| 4,627,627 A | | 12/1986 | Röhm | |
| 4,773,657 A | | 9/1988 | Röhm | |
| 5,048,618 A | | 9/1991 | Lagne | |

(List continued on next page.)

FOREIGN PATENT DOCUMENTS

| | | |
|---|---|---|
| DE | 2610990 | 9/1976 |
| DE | 3224176 | 12/1983 |
| DE | 3329005 | 2/1985 |
| DE | 3422195 | 12/1985 |
| DE | 3432918 | 3/1986 |
| DE | 3931101 | 4/1990 |

(List continued on next page.)

*Primary Examiner*—Scott A. Smith
*Assistant Examiner*—Chukwurah Nathaniel
(74) *Attorney, Agent, or Firm*—Michael P. Leary; Bruce S. Shapiro; Charles E. Yocum

(57) ABSTRACT

An electrically powered hammer comprising a hollow spindle within which spindle is reciprocatingly mounted a piston, a ram, a beatpiece having an increased external diameter mid-portion and located within the spindle between the ram and the tool or bit, a two part sleeve arrangement located within the spindle and including an increased internal diameter mid-portion for receiving the increased external diameter portion of the beatpiece and a reduced internal diameter forward and rearward portion for guiding the forward and rearward ends respectively of the beatpiece and where the sleeve arrangement includes a forward sleeve and a rearward sleeve which are both guided with tight radial tolerances and with a slight axial play within and by the spindle and the forward axial movement of the forward sleeve is limited by a reduced diameter portion of the spindle and the forward axial movement of the rearward sleeve is limited by the forward sleeve.

19 Claims, 4 Drawing Sheets

U.S. PATENT DOCUMENTS

| | | | |
|---|---|---|---|
| 5,050,687 | A | 9/1991 | Prokhorov et al. |
| 5,052,498 | A | 10/1991 | Gustafsson et al. |
| 5,083,499 | A | 1/1992 | Elvingsson |
| 5,088,566 | A | 2/1992 | Gustafsson et al. |
| 5,097,913 | A | 3/1992 | Gustafsson |
| 5,111,890 | A | 5/1992 | Ranger et al. |
| 5,199,833 | A | 4/1993 | Fehrle et al. |
| 5,373,905 | A | 12/1994 | Bleicher et al. |
| 5,450,911 | A | 9/1995 | Gustafsson |
| 5,601,388 | A | 2/1997 | Lauterwald |
| 5,871,059 | A | 2/1999 | Shibata et al. |
| 5,873,418 | A | 2/1999 | Arakawa et al. |
| 5,896,934 | A | 4/1999 | Yaniero et al. |
| 5,896,937 | A | 4/1999 | Kaneko |
| 5,944,118 | A | 8/1999 | Johansson et al. |
| 5,954,140 | A | 9/1999 | Bauer |
| 5,996,708 | A | 12/1999 | Gerold |
| 6,073,705 | A | 6/2000 | Shibata et al. |
| 6,098,723 | A | 8/2000 | Yaniero et al. |
| 6,116,352 | A | 9/2000 | Frauhmammer et al. |

FOREIGN PATENT DOCUMENTS

| | | |
|---|---|---|
| DE | 4100186 | 7/1992 |
| DE | 4215288 | 1/1993 |
| DE | 4400779 | 7/1995 |
| DE | 19621610 | 12/1997 |
| DE | 19651828 | 6/1998 |
| EP | 0164516 | 12/1985 |
| EP | 0175065 | 3/1986 |
| EP | 0494400 | 7/1992 |
| EP | 0663270 | 7/1995 |
| EP | 0688127 | 8/1995 |
| EP | 0847837 | 6/1998 |
| GB | 1507610 | 4/1978 |
| GB | 2160142 | 12/1985 |
| GB | 2313566 | 12/1997 |
| WO | 9301027 | 1/1993 |

* cited by examiner

HAMMER

This application claims the priority of U.K. Patent Application No. GB 0105547.4, filed Mar. 7, 2001 and U.K. Patent Application No. GB 0125749.2, filed Oct. 26, 2001, the contents of which are incorporated herein by reference.

BACKGROUND OF THE INVENTION

1. Field of the Invention

This invention relates to electric hammers having an air cushion hammering mechanism.

2. Description of the Related Art

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more cylindrical parts, which together form the hammer spindle. For example, a front part of the spindle may be formed as a separate tool holder body for retaining the tool or bit. The hammer is normally provided with an impact mechanism comprising a motor that drives a piston, which may be a hollow piston, to reciprocate within the spindle. The piston reciprocatingly drives a ram by means of an air cushion located between the piston and the ram. The impacts from the ram are transmitted to the tool or bit of the hammer via a beatpiece located within the spindle.

Some hammers can be employed in combination impact and drilling mode in which the spindle, or a forwardmost part of the spindle, and hence the bit inserted therein, will be caused to rotate at the same time as the bit is struck by the beat piece.

When the hammer is to be used the forward end of a tool or bit is pressed against a workpiece, which urges the tool or bit rearwardly within the hammer spindle. The tool or bit in turn urges the beatpiece rearwardly into its operating position in which the rearward end of the beatpiece is located within the reciprocating path of the ram. In the operating position the beatpiece receives repeated impacts from the ram. When the hammer is in use, the forward impact from the ram is transmitted through the beatpiece to the bit or tool and through the bit or tool to the workpiece. A reflected impact is reflected from the workpiece and is transmitted through the bit or tool to the beatpiece. This reflected, or reverse impact must be absorbed within the structure of the hammer in such a way that the reverse impacts do not over time destroy the hammer and so that the reverse impacts are not transmitted to the end user.

When the user takes the tool or bit of the hammer away from the workpiece, the next forward impact of the ram on the beatpiece urges the beatpiece forwardly into its idle mode position. The beatpiece can move forwardly and stay forwardly because the tool or bit is no longer urging it rearwardly, because the tool or bit also assumes a forward idle mode position. Because the beatpiece does not now offer much resistive force against the ram, the ram also moves into a forward idle mode position. In the idle mode position of the ram, the air cushion is vented and so any further reciprocation of the piston has no effect on the ram. This forward movement of the components on entry into idle mode generates the greatest impact forces on the structure of the hammer, in particular on the hammer spindle. This is because the forward impact force of these parts on entry into idle mode is not transferred to the workpiece, but has to be absorbed by structure of the hammer itself. Thus, the number of idle strikes, ie. the number of reciprocations of the ram, beatpiece and tool or bit, when the bit or tool is removed from the workpiece need to be minimised in order to minimise the number of high impact force idle strikes that have to be absorbed by the structure of the hammer. This is generally achieved by catching the ram and/or the beatpiece in their idle mode positions so that they cannot slip rearwardly to cause the ram to move into a position in which the air cushion is closed and the ram and thus the beatpiece begin to reciprocate again.

In order for the maximum impact to be transmitted from the ram to the tool or bit, via the beatpiece, the beatpiece must be co-axial with the spindle. Thus, high efficiency is achieved if the reciprocating movement of the beatpiece within the spindle is guided to ensure good axial alignment with the axis of the spindle.

Hammers are necessarily operated in very dusty and dirty environments. If dust gets into the spindle of the hammer it can cause abrasion between the reciprocating parts and, in particular, can cause seals between the ram and the spindle to become worn. Wearing of the seal around the ram will cause the air cushion to deteriorate, which will eventually lead to impacts occurring between the beatpiece and the ram which can seriously damage the hammer. Therefore, a further issue in the longevity of the working life of a hammer is its sealing against dust. The reciprocation of parts within the spindle can draw dust rearwardly inside the hammer spindle, where damage can be caused.

Attempts to solve these problems have been made and examples of the resulting hammer arrangements are known from U.S. Pat. No. 4,476,941 and DE196 21 610.

The arrangement in U.S. Pat. No. 4,476,941 has a complicated multi-part spindle arrangement with a first sleeve for guiding a rearward reduced diameter portion of the beatpiece, which sleeve extends from the inside to the outside of the spindle, between two spindle parts. The impact of the beatpiece on entry into idle mode is absorbed by a second sleeve, located forward of the first and within a different one of the spindle parts. The second sleeve also guides a forward increased diameter portion of the beatpiece. The arrangement in U.S. Pat. No. 4,476,941 has a problem with dust ingress, in particular during periods when a tool or bit is removed from the tool holder of the hammer, into the portion of the forward sleeve where the beatpiece is guided. This problem is exacerbated by the pumping nature of the increased diameter portion of the beatpiece which is guided within the second sleeve. The small amount of axial support for the first sleeve which is mounted between spindle parts, along with usual tolerance limitations for component parts could lead to a reduced accuracy of axial guiding of the beatpiece by the sleeves. The design in U.S. Pat. No. 4,476,941 results in a complicated multi-part spindle, beatpiece guiding and damping structure, with the associated assembly problems and cost implications.

The arrangement in DE196 21 610 overcomes some of the problems discussed above, but still has the disadvantage of a relatively complex three part spindle arrangement, having sleeves for beatpiece guiding mounted and guided in different spindle parts. Again the usual tolerance issues between spindle parts can reduce the accuracy with which the beatpiece is guided and complicates the sealing of dust from the inside of the spindle. Again the design in DE196 21 610 has a complicated multi-part spindle, beatpiece guiding and damping structure, with the associated assembly problems and cost implications.

SUMMARY OF THE INVENTION

The present invention aims to provide a beatpiece guiding and damping arrangement which solves all of the problems discussed and which results in a relatively simple and easy to assemble structure.

According to the present invention there is provided an electrically powered hammer comprising:

a hollow spindle having a reduced diameter tool holder portion at its forward end in which a tool or bit can be releaseably mounted for limited reciprocation, within which spindle is reciprocatingly mounted a piston and a ram of an air cushion hammering mechanism;

a beatpiece having an increased diameter mid-portion, which beatpiece is located within the spindle between the ram and the tool or bit for transmitting repeated impacts from the ram to the tool or bit; and a two part sleeve arrangement located within the spindle and having an increased internal diameter mid-portion for receiving the increased diameter portion of the beatpiece and a reduced internal diameter forward and rearward portion for guiding the forward and rearward ends respectively of the beatpiece in all working positions of the beatpiece, characterised in that the sleeve arrangement is formed by a forward sleeve and a rearward sleeve which are both guided with tight radial tolerances and with a slight axial play within and by the same one piece spindle part and in which the forward axial movement of the forward sleeve is limited by a reduced internal diameter portion of the spindle and the forward axial movement of the rearward sleeve is limited by the forward sleeve.

The sleeve arrangement according to the present invention enables easy assembly of the sleeves and beatpiece and associated components, as a sub-assembly, within a single spindle component part. It also enables simple sealing of the inside of the spindle from dust, as the sleeve arrangement itself forms an effective barrier to dust ingress. In addition, the sleeve arrangement facilitates a reduction in the intensity of impacts on the structure of the hammer on entry into idle mode and catching of the ram and beatpiece in idle mode. On entry into idle mode, the increased diameter portion of the beatpiece hits the forward sleeve and imparts forward momentum to the forward sleeve and itself moves rearwardly, but with relatively low momentum thus facilitating catching of the beatpiece and/or ram. Due to the slight axial play of the sleeve arrangement within the spindle, on entry into idle mode a small gap is located or generated between the front of the forward sleeve and the reduced internal diameter portion of the spindle. When the beatpiece hits the forward sleeve the forward sleeve moves forwardly to close the gap and impact the reduced diameter portion of the spindle. The reflected impact from this collision of the front sleeve causes the front sleeve to then move rearwardly, but not with sufficient speed to impact the beatpiece. Instead the rearward momentum for the forward sleeve is absorbed by a collision with the rearward sleeve, and can be transmitted thereby to the spindle. Thus, the only a small part of the reflected impact from collisions taking place within the spindle on entry into idle mode is transmitted to the beatpiece. As will be described below, the two part sleeve arrangement enables additional advantages to be achieved in an easy to assemble sub-assembly.

As well as the sleeve arrangement itself forming a barrier to the ingress of dust into the interior of the spindle, an annular seal can be located between the beatpiece and said one piece spindle part, in front of the sleeve arrangement. Alternatively, an annular seal can be located between the beatpiece and the forward end of the forward sleeve, and this seal may be recessed within the forward end of the forward sleeve. In this way the beatpiece is guided within the sleeve arrangement in a dust free region of the spindle. In addition an annular seal can be located between the forward sleeve and said one piece spindle part. Thus, the arrangement according to the present invention enables the interior of the spindle to be effectively sealed from the ingress of dust by simple annular seals, such as rubber O-ring seals.

The sleeve arrangement can be arranged to enclose the mid-portion of the beatpiece to form a self-contained sub-assembly, which is assembled into said one piece spindle part. This provides a simple assembly procedure.

In order to reliably catch the beatpiece and/or ram in its forward position on entry into idle mode the mass of the front sleeve preferably is less than or equal to the mass of the beatpiece. In a preferred embodiment the mass of the front sleeve is less than half of the mass of the beatpiece.

In one preferred embodiment of the present invention the beatpiece has a second increased diameter portion, rearward of the first, which second portion is engageable with a resilient beatpiece catching ring. The ring is mounted preferably within the rearward sleeve and is arranged to catch the beatpiece in a forward position in idle mode, by limiting the rearward movement of the second increased diameter portion during idle mode. The inclusion of the beatpiece catching arrangement in the sleeve arrangement, again simplifies assembly as the beatpiece catching ring can be pre-assembled in a sleeve arrangement sub-assembly, which sub-assembly is then assembled into said one piece spindle part.

An annular gap is formed between the peripheral surface of the increased external diameter portion of the beatpiece and increased internal diameter portion of the sleeve arrangement. Thus, as the beatpiece reciprocates within the sleeve arrangement, grease is free to move around the increased diameter portion of the beatpiece and the reciprocation of the beatpiece is less likely to cause dust to travel rearwardly along the spindle.

In one preferred embodiment of the present invention a metal beatpiece impact ring is mounted in the rearward sleeve behind the rearward facing surface of the increased diameter portion of the beatpiece for absorbing reverse impacts from the beatpiece and transmitting the impacts to the rearward sleeve during normal use of the hammer. This enables efficient transmission of reverse impacts from the beatpiece during normal operation of the hammer. Again the impact ring can be assembled into a sleeve arrangement sub-assembly, before assembly of the sub-assembly into said one piece spindle part, thus facilitating efficient assembly procedures. In addition, a damping ring may be mounted in the rearward sleeve behind the impact ring for damping the impacts transmitted from the impact ring to the rearward sleeve. Preferably, the beatpiece damping ring and the beatpiece catching ring are formed by the same component.

The reverse impacts from the beatpiece in normal use of the hammer are efficiently transmitted from the increased diameter portion of the hammer to the spindle via the rearward sleeve. In one preferred embodiment a resilient O-ring is located between a rearward facing external shoulder of the rearward sleeve and a fixing for axially limiting the rearward movement of the rearward sleeve within said one piece spindle part and during normal operation of the hammer, the increased diameter portion of the beatpiece repeatedly abuts a forward facing internal shoulder of the rearward sleeve. Thus, the reverse impacts are transmitted from the beatpiece to the rearward sleeve and are then damped by the O-ring before being transmitted to the spindle via the fixing. Thus, the intensity of the reverse impacts from the beatpiece which are transmitted to the spindle is reduced.

In one preferred embodiment of the present invention a resilient O-ring located between a first forward facing shoulder of the forward sleeve and a first rearward facing shoulder of the spindle urges the forward sleeve into a rearward position within the spindle to open up a gap between a forward facing part of the forward sleeve and a rearward facing part of the spindle, which gap is closed by forward movement of the sleeve on entry into idle mode of the hammer.

The present invention enables simplification of the spindle structure and the hollow spindle may be formed as a single component. Alternatively, the hollow spindle may be formed as two components, for example when it is desired to remove and/or rotate a forward tool holder portion of the spindle from and/or with respect to a rearward portion of the spindle. In particular, a first spindle component may house the piston, ram and beatpiece and a second component may form a tool holder which is removable from the first component.

BRIEF DESCRIPTION OF THE DRAWINGS

Three embodiments of a hammer according to the present invention will now be described by way of example, with reference to the accompanying drawings in which.

DETAILED DESCRIPTION OF THE PREFERRED EMBODIMENT

A preferred embodiment according to the present invention will be described hereinafter with reference to the attached drawings.

Figure 1:
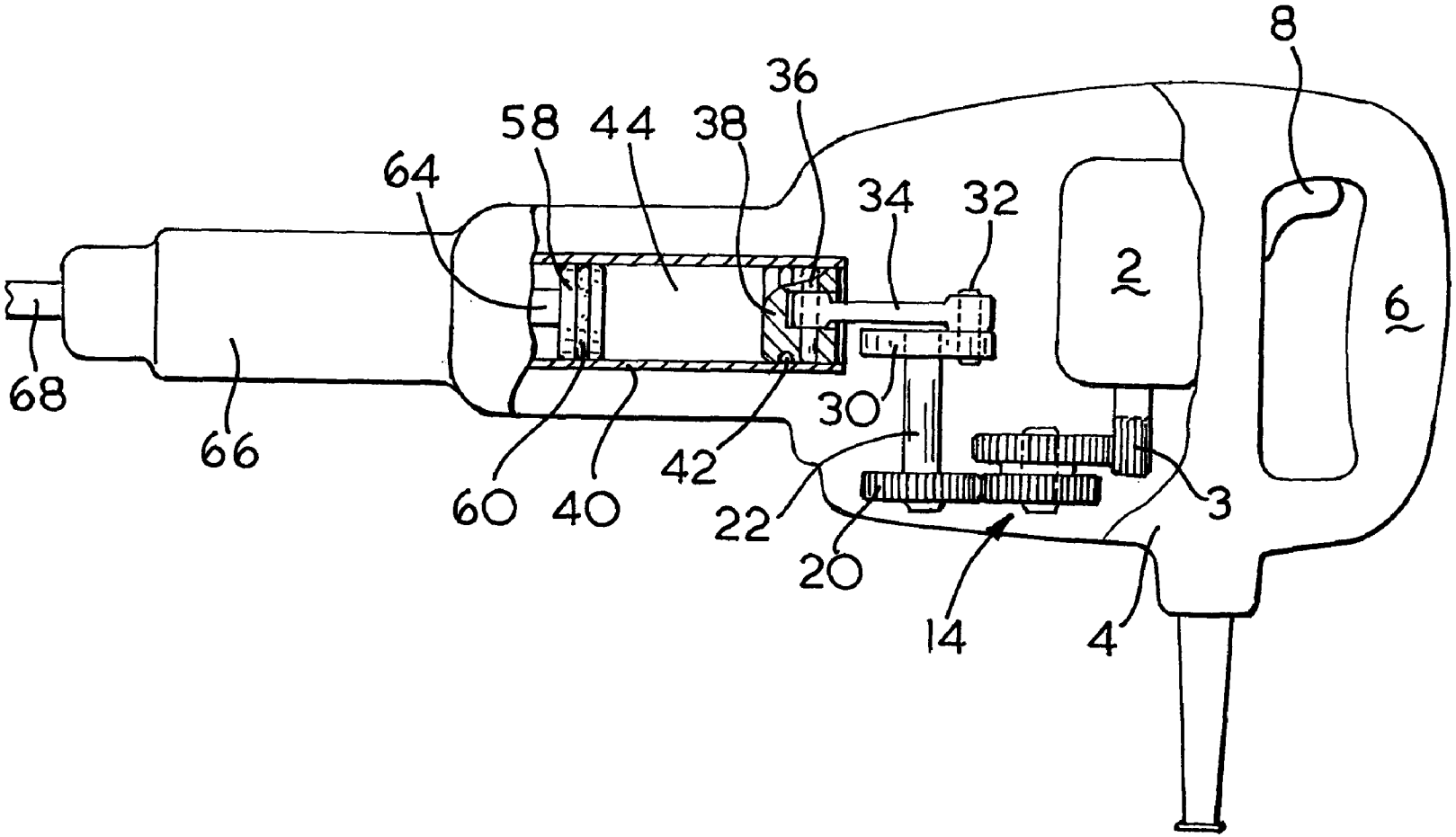
FIG. 1 is a partially cut away side cross-sectional elevation of a demolition hammer.

The hammer shown in FIG. 1 comprises an electric motor (2), an intermediate gear arrangement (14, 20) and a crank drive arrangement (30–36) which are housed within a metal gear housing (not shown) surrounded by a plastic housing (4). A rear handle housing incorporating a rear handle (6) and a trigger switch arrangement (8) is fitted to the rear of the housing (4). A cable (not shown) extends through a cable guide (10) and connects the motor to an external electricity supply. Thus, when the cable is connected to the electricity supply and the trigger switch arrangement (8) is depressed the motor (2) is actuated to rotationally drive the armature of the motor.

A hollow cylindrical spindle (40) is mounted within the hammer housing. A piston (38) and a ram (58) are located within the spindle. The motor (2) drives a crank plate (30) via an intermediate gear arrangement (14, 20). The crankplate (30) reciprocatingly drives the piston (38) within the rearward part of the spindle (40) via a crank arm (34) and trunnion (36) arrangement, as is well known in the art. An O-ring seal (42) is fitted in an annular recess formed in the periphery of the piston (38) so as to form an airtight seal between the piston (38) and the internal surface of the hollow spindle (40).

Thus, when the motor (2) is actuated, the armature pinion (3) rotatingly drives the intermediate gear arrangement (14) which rotatingly drives the crank drive spindle (22) via the drive gear (20). The drive spindle rotatingly drives the crank plate (30) and the crank arm arrangement comprising the crank pin (32), the con-rod (34) and the trunnion pin (36) convert the rotational drive from the crank plate (30) to a reciprocating drive to the piston (38). In this way the piston (38) is reciprocatingly driven back and forth along the hollow spindle (40), when the motor (2) is actuated by depression of the trigger switch (8).

The ram (58) is located within the hollow spindle (40) forwardly of the piston (38) so that it can also reciprocate within the hollow spindle (40). An O-ring seal (60) is located in a recess formed around the periphery of the ram (58) so as to form an airtight seal between the ram (58) and the spindle (40). In the rearward operating position of the ram (58), with the ram located rearward of venting bores (not shown) in the spindle a closed air cushion (44) is formed between the forward face of the piston (38) and the rearward face of the ram (58). Thus, reciprocation of the piston (38) reciprocatingly drives the ram (58) via the closed air cushion (44). When the hammer enters idle mode (ie. when the hammer bit is removed from a workpiece), the ram (58) moves forwardly, past the venting bores. This vents the air cushion and so the ram (58) is no longer reciprocatingly driven by the piston (38) in idle mode, as is well known in the art.

Figure 2:
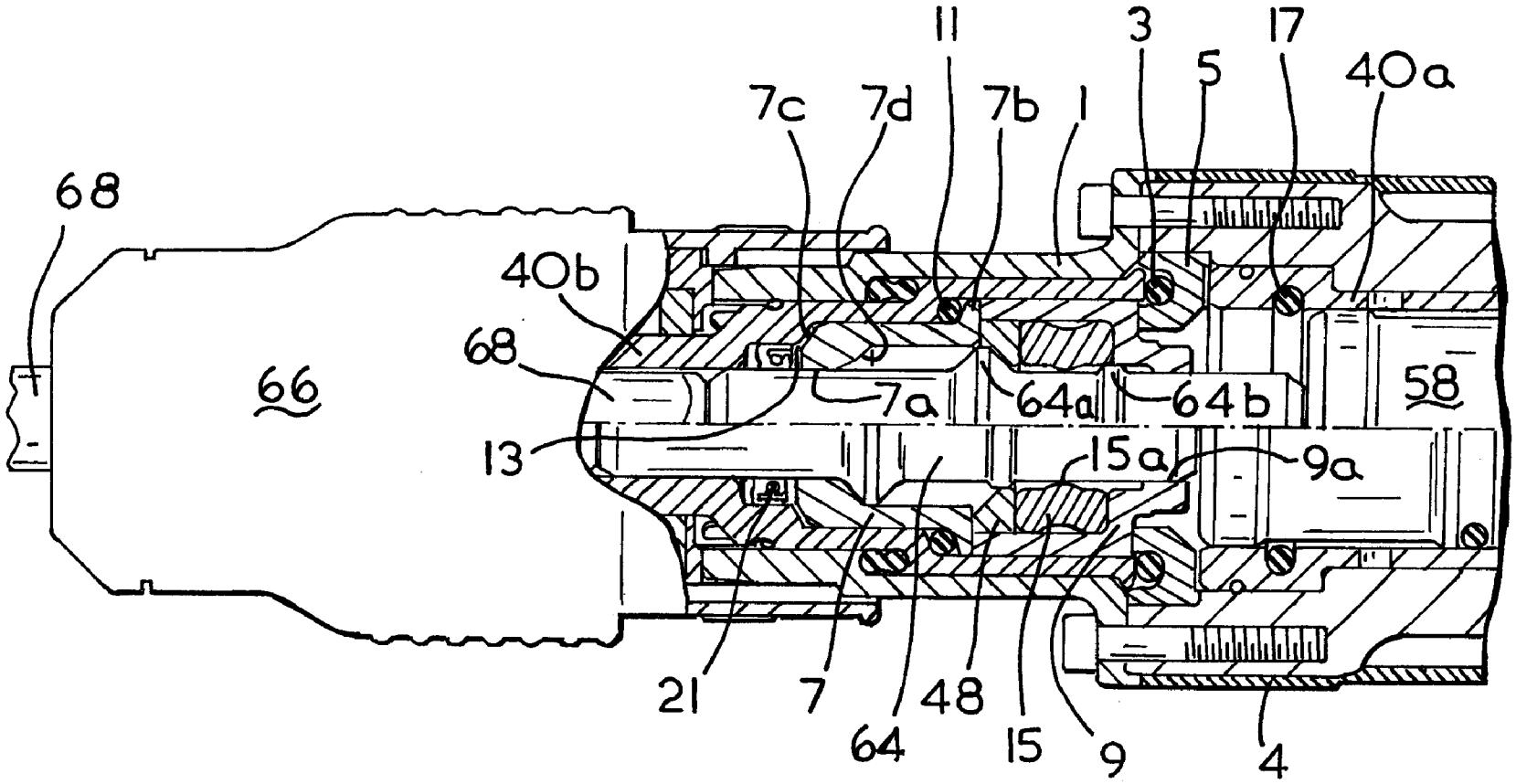
FIG. 2 is a partially cut away side cross sectional elevation of part of the spindle of the demolition hammer of FIG. 1 incorporating the present invention.

FIG. 2 shows in more detail the hollow spindle (40) of the hammer of FIG. 1. The hollow spindle (40) is formed in two parts, a rearward part (40*a*) which houses the piston (38) and the ram (58) and a forward part (40*b*) which reduces in diameter in a stepped manner in the forward direction. The rearward part (40*a*) of the spindle is non-rotatably mounted in the hammer. The forward part (40*b*) of the spindle is rotatably mounted in a flange (1) which is bolted to a metal casing surrounding the rearward part of the spindle (40*a*).

A bit or tool (68) can be releasably mounted, by means of a tool holder arrangement (66) within the forward reduced diameter portion of the forward spindle part (40*b*) so that the bit or tool (68) can reciprocate to a limited extent within the forward spindle part. A beatpiece (64) is mounted within the forward spindle part (40*b*) between the ram (58) and the tool or bit (68) and is supported and guided by a pair of sleeves (7, 9), which are mounted and guided within the forward spindle part (40*b*). In the upper half of FIG. 2, the tool or bit (68), beatpiece (64) and ram (58) are shown in their rearward operating position and in the lower half of FIG. 2, they are shown in their forward idle mode position. When the ram (58) is in its operating mode and is reciprocatingly driven by the piston (38) the ram repeatedly impacts the rearward end of the beatpiece (64) and the beatpiece (64) transmits these impacts to the rearward end of the bit or tool (68) as is known in the art. These impacts are then transmitted by the bit or tool (68) to the material being worked.

The beatpiece (64) is formed with two increased external diameter regions, a forward region (64*a*) and a rearward beatpiece catching region (64*b*). A two part sleeve arrangement (7, 9) is used to guide the beatpiece (64) within the forward spindle part (40*b*). The forward sleeve (7) is formed as a hollow cylinder and has a forward reduced internal diameter guiding portion (7*a*), which fits around and guides a forward reduced external diameter portion of the beatpiece (64). The rearward sleeve (9) is also formed as a hollow cylinder and has a rearward reduced internal diameter guiding portion (9*a*) which fits around and guides a rearward reduced external diameter portion of the beatpiece (64). The external peripheries of the sleeves (7, 9) have close radial tolerances with the cooperating internal surface of the forward spindle part (40*b*) and the two guiding portions (7*a*, 9*a*) are widely axially spaced. Thus, the axial guiding of the beatpiece (64) is very accurate, so that the beatpiece (64) reciprocates with its axis co-axial with the axis of the forward spindle (40*b*). This greatly improves the efficiency with which impacts are transmitted by the beatpiece from the ram (58) to the tool or bit (68).

It is common for beatpieces to be guided around their increased diameter regions. Guiding around the reduced diameter portion enables the beatpiece (64) to be designed to be non-pumping. The forward sleeve (7) and the beatpiece (64) are dimensioned so that there is an annular gap between the outer surface of the forward increased diameter portion (64*a*) of the beatpiece and the inner surface of the increased diameter portion of the sleeve (7). Thus, as the beatpiece (64) reciprocates, grease is free to move between a region in front of the increased diameter portion (64*a*) and a region behind the increased diameter portion (64*a*) of the beatpiece. Thus, reciprocation of the beatpiece (64) does not pump grease forwardly and rearwardly. The pumping of grease rearwardly in the spindle can cause dust to be pumped rearwardly also. The rearward movement of dust within the spindle is undesirable as it can cause abrasion between reciprocating parts.

The rearward sleeve (9) contains a resilient beatpiece catching ring (15), which is formed with a reduced diameter portion (15*a*) having an internal diameter which is less than the external diameter of the rearward increased external diameter portion (64*b*) of the beatpiece. The rearward increased diameter portion (64*b*) of the beatpiece can move past the beatpiece catching ring (15) if the beatpiece can apply a force to great enough to deform the ring (15) sufficiently for the increased diameter portion (64*b*) of the beatpiece to pass over the reduced diameter portion (15*a*) of the beatpiece catching ring.

The front sleeve (7) has a mass, which is approximately 2.3 times less than the mass of the beatpiece (64). A rubber O-ring (11) is located in front of a radially outwardly directed flange (7*b*) at the rear of the sleeve (7) and a rearwardly directed internal shoulder of the forward spindle part (40*b*). The O-ring acts to maintain a small gap (13) between a slanting forward facing annular surface (7*c*) of the sleeve (7) and a slanting rearwardly facing internal shoulder of the forward spindle part (40*b*) during normal operation of the hammer.

On entry into idle mode (bottom half of FIG. 2) as the beatpiece (64) moves into its forwardmost position. The beatpiece has sufficient forward momentum to cause the beatpiece catching ring (15) to deform so that the increased diameter portion (64*b*) of the beatpiece can move forwardly past the reduced diameter portion (15*a*) of the ring (15). The deformation of the ring (15) will absorb some of the forward movement of the beatpiece (64). The forward increase diameter portion (64*a*) of the beatpiece impacts a rearward facing internal shoulder (7*d*) of the forward sleeve (7), thus transferring its forward momentum to the front sleeve (7). The reflected momentum from the sleeve (7) causes the beatpiece (64) to then move rearwardly, but not with sufficient force for the rearward increased diameter portion (64*b*) of the beatpiece to move rearwardly past the beatpiece catching ring (15).

The front sleeve (7) on being impacted by the beatpiece (64) moves forwardly to close the gap (13) and transfers its forward momentum to the spindle part (40*b*). The reflected momentum from the spindle part (40*b*) causes the sleeve (7) to move rearwardly, but not with sufficient speed to catch up with the beatpiece (64). The rearward momentum from the front sleeve (7) is transferred to the rear sleeve (9). Thus, the reflected momentum of the forward sleeve (7) is not transmitted to the beatpiece, which remains caught in its idle mode position by the beatpiece catching ring (15). It should be noted that the O-ring (11) has only a marginal damping effect on the forward movement of the forward sleeve (7) and on entry into idle mode substantially all of the forward impact from the sleeve (17) is transmitted to the spindle part (40*b*).

Thus, on entry into idle mode the beatpiece is effectively caught in its forward idle mode position by the beatpiece catching ring (15). This means that the beatpiece (64) cannot move rearwardly to impact the ram (58), which could cause the ram to move rearwardly out of its idle mode position. The ram (58) is caught in its idle mode position by a ram catching O-ring (17) which engages an increased diameter portion (58*a*) of the ram. Thus, the ram (58) is prevented from returning to its operating position in idle mode and so potentially damaging idle mode impacts are avoided.

When a user wishes to use the hammer again, the tool or bit (68) is pressed against a working surface and so the tool or bit is urged rearwardly in the spindle part (40*b*) to urge the beatpiece (64) rearwardly, to release it from the beatpiece catching ring (15). The beatpiece (64) urges the ram (58) rearwardly and out of the ram catcher (17) to close the vents and form a closed air cushion between the piston (38) and the ram (58). Thus, when the user actuates the trigger switch (8) of the hammer the piston (38) is reciprocatingly driven in the spindle part (40*a*) and the ram (58) follows the reciprocation of the piston due to the closed air cushion and hammering occurs.

In addition the rearward sleeve (9) houses a metal beatpiece damping ring (48) for absorbing reflected impacts to the beatpiece (64) during operation of the hammer, which impacts are damped by the resilient beatpiece catching ring (15). The damping ring (48) is located within the sleeve arrangement between the forward increased diameter portion (64*a*) of the beatpiece and the resilient ring (15) and absorbs the impacts transmitted to the rearward sleeve (9) in use of the hammer (top half of FIG. 2). The reflected impacts, which are transmitted from the working surface, via the tool (68) to the beatpiece (64) are damped by the resilient ring (15) before they are transmitted to the rearward sleeve (9). The damped rearwardly directed impacts from the beatpiece (64) are transmitted via the connecting part (5) to the rear spindle part (40*a*).

The two part sleeve arrangement (7, 9) has a seal (21) located forwardly of it for sealing around between beatpiece (64) and the forward spindle part (40*b*). This seals around the beatpiece against dust entering the part of the spindle (40*a*, 40*b*) behind the seal (21) and against grease leaving the part of the spindle behind the seal (21). As the seal (21) is located forwardly of the sleeve arrangement (7, 9) the guiding of the beatpiece (64) using guiding portions (7*a*, 9*a*) is done entirely within the grease filled region of the spindle part (40*b*). Furthermore, the sleeve (7, 9), O-ring (11), damper (48) and beatpiece catching ring (15) fill the space between the beatpiece (64) and the spindle part (40*b*) and so provides a physical barrier to the ingress of dust.

The guiding of the rearward portion of the beatpiece (64) by the guiding region (9*a*) of the rearward sleeve (9) is very close to the rearward end of the beatpiece. In the arrangement in FIG. 1 the greatest distance between the rearward guiding portion (9*a*) and the rearward end of the beatpiece is minimised to be little more than the length of stroke of the beatpiece, as can bee seen by comparing the upper and lower halves of FIG. 2. When the ram (58) hits the beatpiece (64), the impact force has a small radial component, which generates a moment between the rearward end of the beatpiece and the most rearward part of the beatpiece that is guided. This moment is therefore minimised, thus reducing the stress on the beatpiece.

The sleeves (7, 9) are mounted within the spindle part (40*b*) with close tolerances between the external surfaces of the sleeves and the internal surface of the spindle. However, the sleeves (7, 9) are mounted so as to be able to have a limited axial movement within the spindle, as described above. Forward movement of the front sleeve (7) is limited by the resilient O-ring (11) and by the rearward facing internal shoulders of the spindle part (40*b*). The forward end of the rearward sleeve (9) abuts the rearward end of the forward sleeve (7) and rearward movement of the rearward sleeve (9) is limited by the connecting part (5) located between the rearward end of the forward spindle part (40*b*) and the forward end of the rearward spindle part (40*a*). It can be seen that the two part sleeve design described above and shown in FIG. 2 facilitates easy assembly of the beatpiece (64), sleeves (7, 9) and other associated components from the rearward end within the forward spindle part (40*b*).

Figure 3:
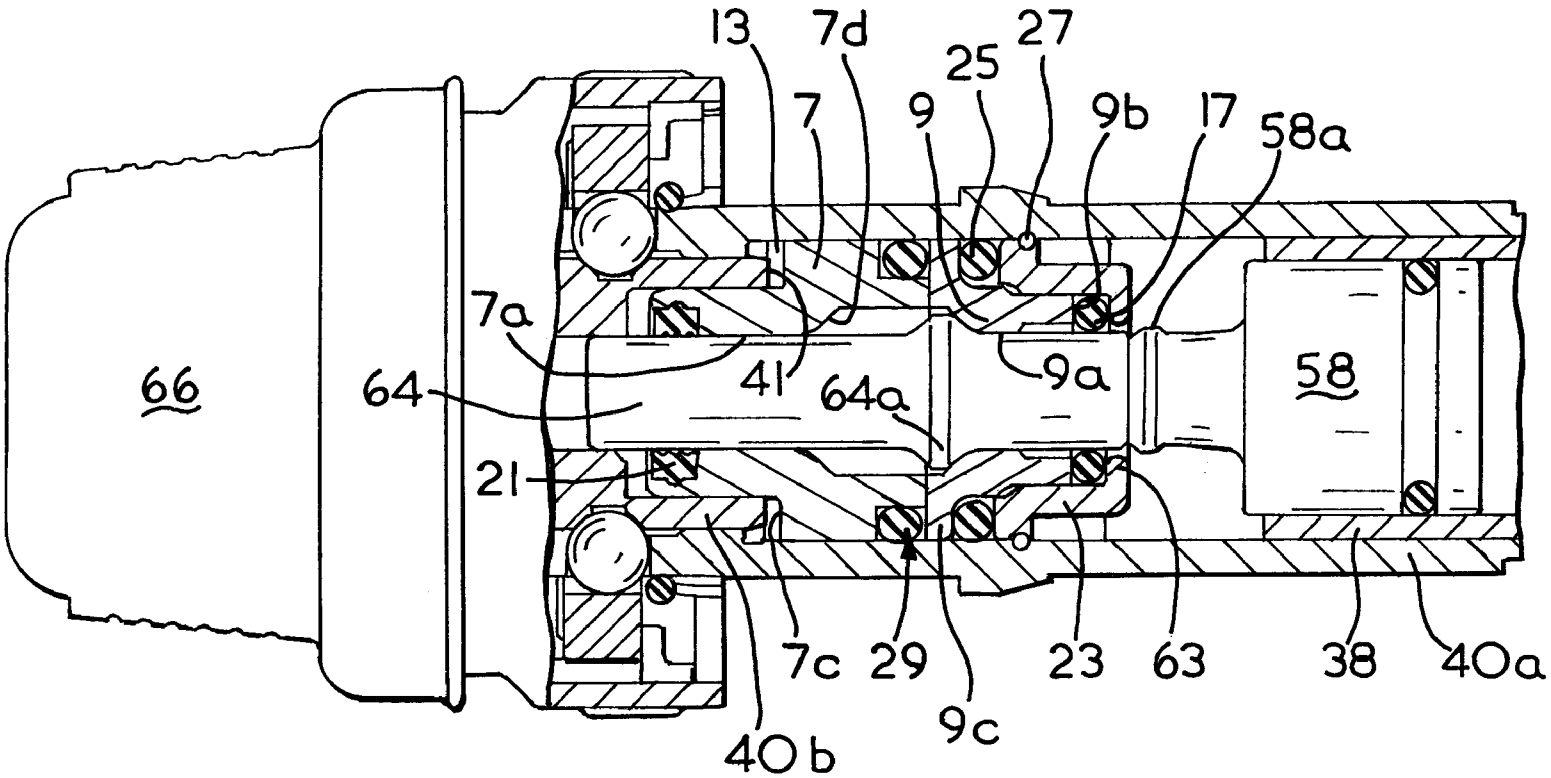
FIG. 3 is a partially cut away side cross-sectional elevation of a portion of a spindle of a rotary hammer incorporating the present invention.
Figure 4:
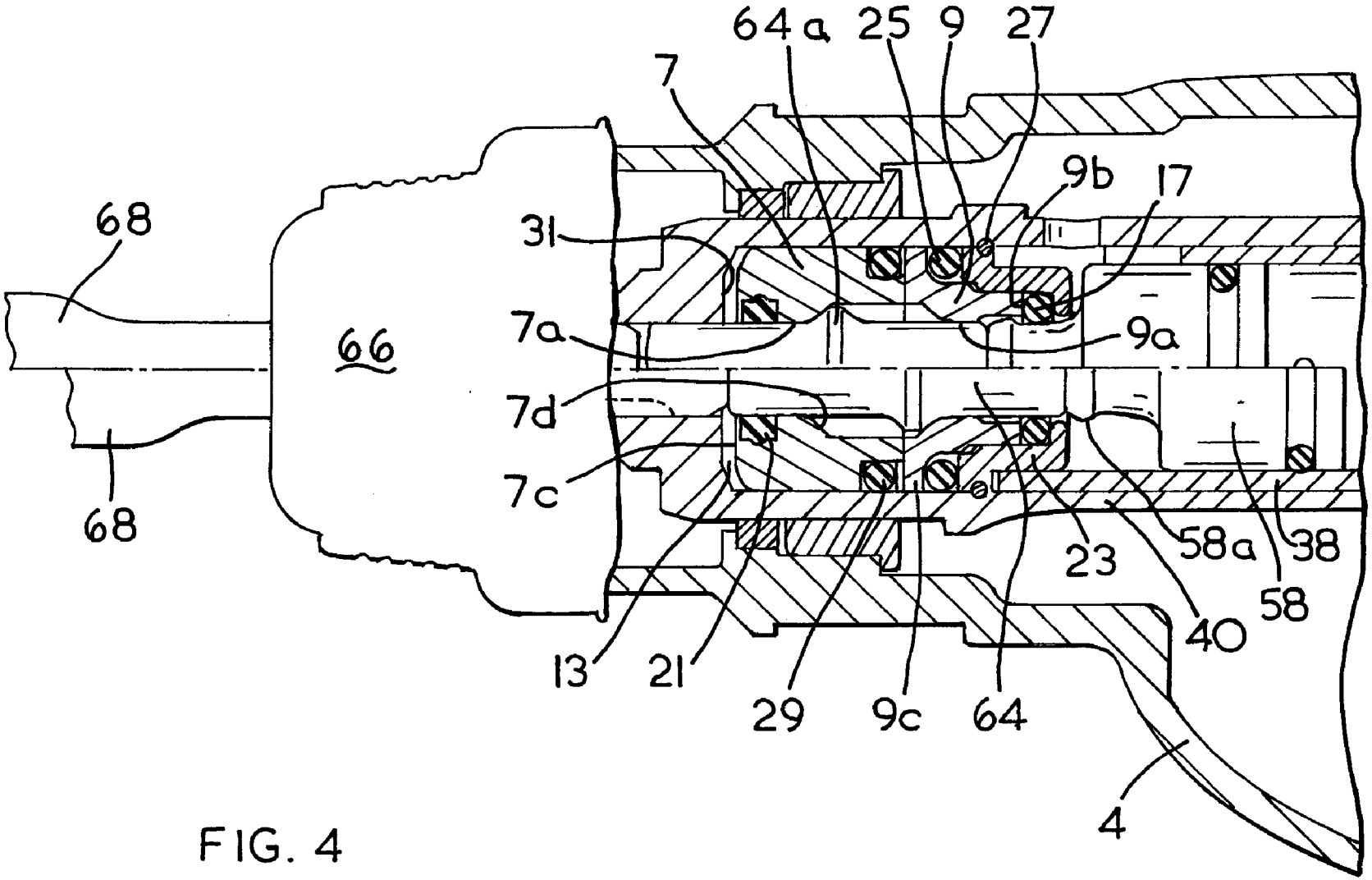
FIG. 4 is a partially cut away side cross-sectional elevation of a portion of a spindle of a rotary hammer incorporating the present invention.

FIGS. 3 and 4 show two different embodiments of the forward part of the spindle of a rotary hammer, with like parts to FIGS. 1 and 2 identified with like numerals. The rotary hammer is of the type having a wobble drive to a hollow piston. The hollow piston (38) reciprocates within the rearward part (40, 40*a*) of a one or two part spindle (40, 40*a*, 40*b*) and the ram (58) reciprocates within the hollow spindle, with the closed air cushion formed within the hollow piston, behind the ram. Such hammers are known in the art.

In FIG. 3 the beatpiece (64) and ram (58) are shown in their rearward operating position. The hollow spindle (40) is formed in two parts, a rearward part (40*a*) which houses the piston (38) and the ram (58) and a forward part (40*b*) which reduces in diameter in a stepped manner in the forward direction. The rearward part (40*a*) of the spindle is rotatably mounted in the hammer. The rearward end of the forward part (40*b*) of the spindle is mounted within the forward end of rearward part (40*a*) of the spindle, in a releaseable manner. A bit or tool (not shown) can be releasably mounted, by means of a tool holder arrangement (66) within the forward reduced diameter portion of the forward spindle part (40*b*) so that the bit or tool can reciprocate to a limited extent within the forward spindle part. A beatpiece (64) is mounted within the rearward spindle part (40*a*) between the ram (58) and the tool or bit (68) and is supported and guided by a pair of sleeves (7, 9), which are mounted and guided within the rearward spindle part (40*a*). As the forward spindle part (40*b*) is removable the sleeve arrangement is mounted within and is guided within the rearward spindle part (40*a*). When the ram (58) is in its operating mode and is reciprocatingly driven by the piston (38) the ram repeatedly impacts the rearward end of the beatpiece (64) and the beatpiece (64) transmits these impacts to the rearward end of the bit or tool (68) as is known in the art. These impacts are then transmitted by the bit or tool (68) to the material being worked.

The beatpiece (64) is formed with one increased external diameter region (64*a*). A two part sleeve arrangement (7, 9) is used to guide the beatpiece (64) within the rearward spindle part (40*a*). The forward sleeve (7) is formed as a hollow cylinder and has a forward reduced internal diameter guiding portion (7*a*), which fits around and guides a forward reduced external diameter portion of the beatpiece (64). The rearward sleeve (9) is also formed as a hollow cylinder and has a rearward reduced internal diameter guiding portion (9*a*), which fits around and guides a rearward reduced external diameter portion of the beatpiece (64). The two guiding portions (7*a*, 9*a*) are widely axially spaced and so the axial guiding of the beatpiece (64), so that the beatpiece (64) reciprocates with its axis co-axial with the axis of the spindle (40*a*), is very accurate. This greatly improves the efficiency with which impacts are transmitted by the beatpiece from the ram (58) to the tool or bit (68).

The sleeves (7, 9) and the beatpiece (64) are dimensioned so that there is an annular gap between the outer surface of the increased external diameter portion (64*a*) of the beatpiece and the inner surface of the increased internal diameter portions of the sleeves (7, 9). Thus, as the beatpiece (64) reciprocates, grease is free to move between a region in front of the increased diameter portion (64*a*) and a region behind the increased diameter portion (64*a*) of the beatpiece. Thus, reciprocation of the beatpiece (64) does not pump grease forwardly and rearwardly.

A ram catching sleeve (23) is located within the spindle part (40*a*) behind the rearward sleeve (9), partially surrounding the rearward end of the rearward sleeve (9). The ram catching sleeve has a radially inwardly directed flange (63) formed at its rearward end the forward face of which is spaced from the rearward end (9*a*) of the rearward sleeve (9). In this space is located a resilient O-ring (17) for catching the ram in its idle mode position. On entry into idle mode the forward reduced diameter portion of the ram (58) moves forwardly into the rearward end of the ram catching sleeve (23) and an annular nub (58*a*) formed at the front of the reduced diameter portion of the ram (58) the ram is caught in front of the resilient O-ring (17).

The front sleeve (7) has a mass, which is substantially the same as the mass of the beatpiece (64). A slight axial play in the location of the sleeves (7, 9) within the spindle part (40*a*) enables a gap (13) to be created between a forward facing annular surface (7*c*) of the sleeve (7) and a rearwardly facing end face (41) of the forward spindle part (40*b*). During normal operation of the hammer, the gap (13) may or may not exist depending on the position of the forward sleeve (7). On entry into idle mode, if there is no gap (13), when the first idle strike occurs, then due to the rearward movement of the sleeve (7) due to reflected momentum from its impact with the spindle part (40*b*) during the first idle strike, the gap (13) will exist when the second idle strike occurs.

With the gap (13) existing, on entry into idle mode, the ram (58) moves into its forward position, in which it is caught in the ram catching O-ring (17). The beatpiece (64) moves into its forwardmost position and the increase diameter portion (64*a*) of the beatpiece impacts a rearward facing internal shoulder (7*d*) of the forward sleeve (7), thus transferring its forward momentum to the front sleeve (7). The reflected momentum from the sleeve (7) causes the beatpiece (64) to then move rearwardly, but not with a sufficient momentum for the beatpiece (64) to impact the ram (38) with sufficient force to dislodge the ram (58) from the ram catching O-ring (17).

The front sleeve (7) on being impacted by the beatpiece (64) moves forwardly to close the gap (13) and transfers its forward momentum to the rearward end face (41) of the spindle part (40*b*). The reflected momentum from the spindle part (40*b*) causes the sleeve (7) to move rearwardly, but not with sufficient speed to catch up with the beatpiece (64). The rearward momentum from the front sleeve (7) is transferred to the rear sleeve (9) and from the rear sleeve (9) to the spindle part (40*a*) via the damping ring (25), ram catching sleeve (23) and the snap ring (27). Thus, the reflected momentum of the forward sleeve (7) is not transmitted to the beatpiece, which remains caught in its idle mode position by the ram (58).

Thus, on entry into idle mode the beatpiece and ram are caught in their forward idle mode position by the ram catching ring (17). This means that the ram (58) cannot move rearwardly out of its idle mode position. Thus, the ram (58) is prevented from returning to its operating position in idle mode and so further potentially damaging idle mode impacts are avoided.

When a user wishes to use the hammer again, the tool or bit (68) is pressed against a working surface and so the tool or bit is urged rearwardly in the spindle part (40*b*) to urge the beatpiece (64) rearwardly, the beatpiece (64) urges the ram (58) rearwardly and out of the ram catcher (17) to close the vents and form a closed air cushion between the piston (38) and the ram (58). Thus, when the user actuates the trigger switch (8) of the hammer the piston (38) is reciprocatingly driven in the spindle part (40*a*) and the ram (58) follows the reciprocation of the piston due to the closed air cushion and hammering occurs.

In addition the rearward sleeve (9) acts to damp reflected impacts to the beatpiece (64) during operation of the hammer. A resilient O-ring (25) is located between a radially outwardly directed flange (9*c*) of the rearward sleeve (9) and the forward end face of the ram catching sleeve (23). The ram catching sleeve (23) is held against rearward movement within the spindle part (40*a*) by a snap ring (27). The O-ring (25) damps the reflected impacts which are transmitted from the working surface, via the tool (68) to the beatpiece (64). The beatpiece (64) transmits these impacts to the sleeve (9), which transmits the impacts via the damping ring (25), which damps the impacts, via the sleeve (23) and snap ring (27) to the spindle part (40*a*).

The two part sleeve arrangement (7, 9) has a seal (21) recessed within the forward end of the front sleeve (7) for sealing around the beatpiece (64). The O-rings (25) and (29) act to form a seal between the exterior of the sleeves (7, 9) and the internal surface of the spindle part (40*a*). This seals around the beatpiece against dust entering the part of the spindle part (40*a*) behind the seals (21, 25, 29) and against grease leaving the part of the spindle behind the seals (21, 25, 29). As the seal (21) is located at the forward end of the sleeve arrangement (7, 9) the guiding of the beatpiece (64) using guiding portions (7*a*, 9*a*) is done within the grease filled region of the spindle part (40*a*). Furthermore, the sleeves (7, 9) and beatpiece (64) fill the space between the beatpiece (64) and the spindle part (40*a*) and so provide a physical barrier to the ingress of dust.

The sleeves (7, 9) are mounted within the spindle part (40*a*) with close tolerances between the radially outermost parts of the sleeves and the internal surface of the spindle. However, the sleeves (7, 9) are mounted so as to be able to have a limited axial movement within the spindle, as described above. Forward movement of the front sleeve (7) is limited by the rearward end face of the spindle part (40*b*). The forward end of the rearward sleeve (9) abuts the rearward end of the forward sleeve (7) and rearward movement of the rearward sleeve (9) is limited by the ram catching sleeve (23) and snap ring (27). It can be seen that the two part sleeve design described above and shown in FIG. 3 facilitates easy assembly of the beatpiece (64), sleeves (7, 9) and other associated components from the rearward end within the forward spindle part (40*a*).

The arrangement in FIG. 4 is similar to that shown in FIG. 3, except that the spindle (40) is a single piece with a forward end having a stepped reduced diameter portion acting as a tool holder for a tool or bit (68). Therefore, the forward movement of the forward sleeve (7) is limited by a rearward facing internal shoulder (31) formed in the spindle (40). The top half of FIG. 4 shows the hammer components in their idle mode position, with the ram (58) caught in the ram catching O-ring (17). The bottom half of FIG. 4 shows the hammer components in their operating positions.

What is claimed is:

1. An electrically powered hammer comprising:

a hollow spindle including a tool holder portion at its forward end in which a tool can be releaseably mounted for limited reciprocation;

a piston mounted within the spindle for reciprocating motion;

a ram of an air cushion hammering mechanism;

a beatpiece including a first increased external diameter mid-portion located within the spindle between the ram and the tool for transmitting repeated impacts from the ram to the tool;

a two part sleeve arrangement located within the spindle and having an increased internal diameter mid-portion for receiving the increased external diameter mid-portion of the beatpiece and a reduced internal diameter forward and rearward portions for guiding the forward and rearward ends respectively of the beatpiece in all working positions of the beatpiece; and wherein the two part sleeve arrangement comprises a forward sleeve and a rearward sleeve which are both guided with tight radial tolerances and with slight axial play within and by the spindle and in which the forward axial movement of the forward sleeve is limited by a reduced internal diameter portion of the spindle and the forward axial movement of the rearward sleeve is limited by the forward sleeve.

2. A hammer according to claim 1 further comprising an annular seal located in front of the forward sleeve between the beatpiece and the spindle.

3. A hammer according to claim 1 further comprising an annular seal located between the beatpiece and a forward end of the forward sleeve.

4. A hammer according to claim 1 further comprising an annular seal located between the beatpiece and the forward end of the forward sleeve and the annular seal is recessed within a forward end of the forward sleeve.

5. A hammer according to claim 1 further comprising an annular seal located between the forward sleeve and the spindle.

6. A hammer according to claim 1 wherein the sleeve arrangement encloses the mid-portion of the beatpiece to form a self-contained sub-assembly, which is assembled into said one piece spindle part.

7. A hammer according to claim 1 wherein the beatpiece has a mass and the front sleeve has a mass less than or equal to the mass of the beatpiece.

8. A hammer according to claim 1 wherein the beatpiece has a mass and the front sleeve has a mass less than half of the mass of the beatpiece.

9. A hammer according to claim 1 wherein the beatpiece includes a second increased external diameter portion, rearward of the first increased external diameter mid-portion, which is engageable with a resilient beatpiece catching ring, which catching ring is mounted within the rearward sleeve, for catching the beatpiece in a forward position in an idle mode of the hammer.

10. A hammer according to claim 1 wherein an annular gap is defined between a peripheral surface of the increased external diameter mid-portion of the beatpiece and increased an internal diameter portion of the sleeve arrangement.

11. A hammer according to claim 1 further comprising a metal beatpiece impact ring mounted in the rearward sleeve behind a rearward facing surface of the first increased diameter portion of the beatpiece for absorbing reverse impacts from the beatpiece and transmitting the impacts to the rearward sleeve.

12. A hammer according to claim 1 further comprising:

a metal impact ring mounted in the rearward sleeve behind a rearward facing surface of the first increased diameter portion of the beatpiece for absorbing reverse impacts from the beatpiece and transmitting the impacts to the rearward sleeve; and a damping ring mounted in the rearward sleeve behind the impact ring for damping the impacts transmitted from the impact ring to the rearward sleeve.

13. A hammer according to claim 1 wherein the beatpiece includes a second increased external diameter portion, rearward of the first increased external diameter mid-portion, which is engageable with a resilient beatpiece catching ring, said ring mounted within the rearward sleeve, for catching the beatpiece in a forward position in an idle mode, and the hammer further comprising:

a metal impact ring mounted in the rearward sleeve behind a rearward facing surface of the second increased external diameter portion of the beatpiece for absorbing reverse impacts from the beatpiece and transmitting the impacts to the rearward sleeve; and a damping ring mounted in the rearward sleeve behind the impact ring for damping the impacts transmitted from the impact ring to the rearward sleeve and for catching the beatpiece in a forward position in an idle mode of the hammer.

14. A hammer according to claim 1 wherein reverse impacts from the beatpiece are transmitted from the first increased external diameter mid-portion of the beatpiece to the spindle via the rearward sleeve.

15. A hammer according to claim 1 wherein reverse impacts from the beatpiece are transmitted from the first increased external diameter mid-portion of the beatpiece to the spindle via the rearward sleeve and a resilient O-ring is located between a rearward facing external shoulder of the rearward sleeve and a fixing for axially limiting the rearward movement of the rearward sleeve within the spindle and during operation of the hammer, the first increased external diameter mid-portion of the beatpiece repeatedly abuts a forward facing internal shoulder of the rearward sleeve.

16. A hammer according to claim 1 further comprising a resilient O-ring located between a first forward facing shoulder of the forward sleeve and a first rearward facing shoulder of the spindle, the resilient o-ring urging the forward sleeve into a rearward position within the spindle to define a gap between a forward facing part of the forward sleeve and a rearward facing part of the spindle, which gap is closed by forward movement of the sleeve on entry into an idle mode of the hammer.

17. A hammer according to claim 1 wherein the hollow spindle is formed as a single component.

18. A hammer according to claim 1 wherein the spindle comprises at least two components.

19. A hammer according to claim 1 wherein the spindle comprises a first component which houses the piston, ram and beatpiece and a second component that forms a tool holder which is removable from the first component.

* * * * *